US012378793B2

(12) United States Patent
Chick

(10) Patent No.: US 12,378,793 B2
(45) **Date of Patent: *Aug. 5, 2025**

(54) HEAT REFLECTIVE SHIELD

(71) Applicant: James Chick, Butler, PA (US)

(72) Inventor: James Chick, Butler, PA (US)

(73) Assignee: James Chick, Butler, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/538,040

(22) Filed: Dec. 13, 2023

(65) Prior Publication Data

US 2024/0110404 A1 Apr. 4, 2024

Related U.S. Application Data

(63) Continuation of application No. 17/506,963, filed on Oct. 21, 2021, now Pat. No. 11,879,259.

(51) Int. Cl.

| | |
|---|---|
| ***E04H 15/20*** | (2006.01) |
| ***E04H 15/00*** | (2006.01) |
| ***E04H 15/54*** | (2006.01) |

(52) U.S. Cl.

CPC ..... *E04H 15/20* (2013.01); *E04H 15/005* (2013.01); *E04H 15/54* (2013.01); *E04H 2015/201* (2013.01); *E04H 2015/206* (2013.01); *E04H 2015/207* (2013.01)

(58) Field of Classification Search

CPC ..... E04H 15/005; E04H 15/20

See application file for complete search history.

(56) References Cited

U.S. PATENT DOCUMENTS

| | | | | |
|---|---|---|---|---|
| 2,752,928 A * | 7/1956 | Barker | ..... | E04H 15/20 52/2.21 |
| 2,830,606 A * | 4/1958 | Daugherty | ..... | E04H 15/20 52/2.14 |
| 2,946,337 A * | 7/1960 | Wolshin | ..... | E04H 15/20 52/2.21 |
| 3,145,719 A * | 8/1964 | Johnson | ..... | E04H 15/20 52/2.21 |

(Continued)

FOREIGN PATENT DOCUMENTS

| | | | | |
|---|---|---|---|---|
| CA | 2265130 A1 * | 9/2000 | ..... | E04H 15/003 |
| DE | 3219879 A * | 12/1983 | ..... | E04H 15/003 |

(Continued)

*Primary Examiner* — David R Dunn
*Assistant Examiner* — Danielle Jackson
(74) *Attorney, Agent, or Firm* — Wei Yu; Michael E. Dukes; Dentons Cohen & Grigsby, P.C.

(57) ABSTRACT

A lightweight heat reflective shield useful for hikers and campers to reflect heat from a campfire back toward themselves. The heat reflective shield includes a base panel and a concave body portion attached to and extending upward from the base panel and supported by at least two inflatable ribs. The concave body portion includes an open front face along a front edge of the base panel, an inner side, and an outer side, wherein at least a portion of the inner side includes a heat reflective material. When the inflatable ribs are filled with air, the heat reflective shield may accommodate a standing or seated person, and when positioned adjacent a heat source, the heat reflective material of the inner side reflects heat from the heat source back toward the heat source.

11 Claims, 9 Drawing Sheets

(56) References Cited

U.S. PATENT DOCUMENTS

| | | | | | |
|---|---|---|---|---|---|
| 3,840,919 | A * | 10/1974 | Middleton | E04H 15/20 | 52/2.21 |
| 3,899,853 | A * | 8/1975 | Wertman | E04H 15/20 | 135/125 |
| 3,991,769 | A * | 11/1976 | Paz | E04H 15/003 | 607/95 |
| 4,120,024 | A * | 10/1978 | Aizenberg | E04H 15/20 | 362/147 |
| D259,664 | S * | 6/1981 | Curless | D25/16 | |
| 4,685,728 | A * | 8/1987 | Rebollo | A47C 7/021 | 52/2.21 |
| 5,623,919 | A * | 4/1997 | Kelly | A47C 7/748 | 126/552 |
| 5,743,049 | A * | 4/1998 | Thallemer | E04H 15/20 | 52/2.21 |
| D744,053 | S * | 11/2015 | Cirjak | D21/835 | |
| 2009/0249701 | A1* | 10/2009 | Turcot | E04H 15/20 | 52/2.18 |
| 2016/0201351 | A1* | 7/2016 | Pirkle | E04H 15/20 | 135/121 |

FOREIGN PATENT DOCUMENTS

| | | | | |
|---|---|---|---|---|
| DE | 202021000796 | U1 * | 5/2021 | |
| FR | 992086 | A * | 10/1951 | |
| GB | 2443821 | A * | 5/2008 | E04H 15/20 |

* cited by examiner

HEAT REFLECTIVE SHIELD

RELATED APPLICATIONS

This application is a continuation of U.S. patent application Ser. No. 17/506,963 filed on Oct. 21, 2021, the entire contents of which is hereby incorporated by reference in its entirety.

FIELD OF INVENTION

This disclosure generally relates to light-weight, portable devices useful for reflecting the radiant heat of a campfire or other heat source back toward a user to improve the user's comfort.

BACKGROUND

Hiking and camping are extremely popular pastimes, even during cold weather months. Shelters useful in cold climates are available, such as tents that may insulate the occupant against the cold. For example, U.S. Pat. No. 2,819,724 and Chinese Pat. No. 203034900U each describe a double walled pneumatic tent configured for use in cold weather as an emergency shelter. These tents are described as simple to erect and foldable into a compact bundle, however both are generally too large and bulky to be easily carried for longer distances. When hiking, in particular, such a shelter needs to be portable so that the hiker is not overly burdened with the weight of a bulky enclosure.

Each of U.S. Pat. No. 9,080,345, European Pat. No. 0212650, Japanese Pat. Appln. No. 2014/084552A, Korean Pat. No. 101951350, and Chinese Pat. Appln. No. 2018/57799U disclose portable inflatable tents configured for use in cold weather. While each of these shelters may include aspects configured to be heat preserving, such as reflective linings, none are useful for warming a hiker by a campfire or other heat source. That is, all generally rely on the hiker's or camper's body heat to warm the inside of the tent.

Prior art heat reflectors that are positionable near a heat source such as a campfire that may assist in warming a user are known. For example, U.S. Pat. Appln. Nos. 2019/0112834 and 2021/0123260 each disclose a campfire reflective barrier comprising a plurality of sturdy barrier walls, such as shown in FIG. 1 reproduced from the latter. Similarly, U.S. Pat. No. 5,979,434 discloses a heat reflector that includes a foldable array of panel members, such as shown in FIG. 2 reproduced therefrom. While indicated to be foldable, none of these prior art reflectors are easily packed and carried by a hiker. Somewhat more transportable arrangements are disclosed in U.S. Pat. Nos. 5,263,468 and 9,383,113, which disclose heat reflective shields that utilize poles for support.

Accordingly, a smaller compact heat reflective shield that may be easily carried, such as in a hiker's backpack, are desired and an object of the present disclosure.

BRIEF SUMMARY

The systems and methods of the present disclosure solve many of the aforementioned problems by providing light weight concave devices that are portable in a deflated state, such as in a hiker's or camper's backpack, and may be inflated to provide an efficient heat reflective shield when positioned adjacent a campfire or other heat source. The heat reflective shields do not require poles for support, thus reducing their overall weight and dimensions when in the deflated, packed state.

According to its major aspects, and briefly stated, the present disclosure relates to a light weight, heat reflective shield comprising a base panel having opposing first and second side edges, and a front edge, and a concave body portion attached to and extending upward from the base panel and supported by at least two inflatable ribs. When the inflatable ribs are filled with air, the heat reflective shield is sized and configured to accommodate a standing or reclining person. Moreover, each of the base panel and concave body portion are composed of light weight flexible material so that the shield may be portable when in the deflated state, such as folded within a backpack.

The concave body portion generally includes an open front face along the front edge of the base panel, an inner side, and an outer side, wherein at least a portion of the inner side comprises a heat reflective material. When the heat reflective shield is positioned adjacent a heat source, the heat reflective material of the inner side reflects heat from the heat source back thereto.

The front face of the concave body portion may include one or more flaps formed of a non-reflective material and configured to enclose the inner side of the concave body portion.

DESCRIPTION OF THE DRAWINGS

Aspects, features, benefits, and advantages of the embodiments herein will be apparent with regard to the following description, appended claims, and accompanying drawings. In the following figures, like numerals represent like features in the various views. It is to be noted that features and components in these drawings, illustrating the views of embodiments of the presently disclosed invention, unless stated to be otherwise, are not necessarily drawn to scale. The present invention described herein may be better understood by reference to the accompanying drawing sheets, in which:

DETAILED DESCRIPTION

Figure 1:
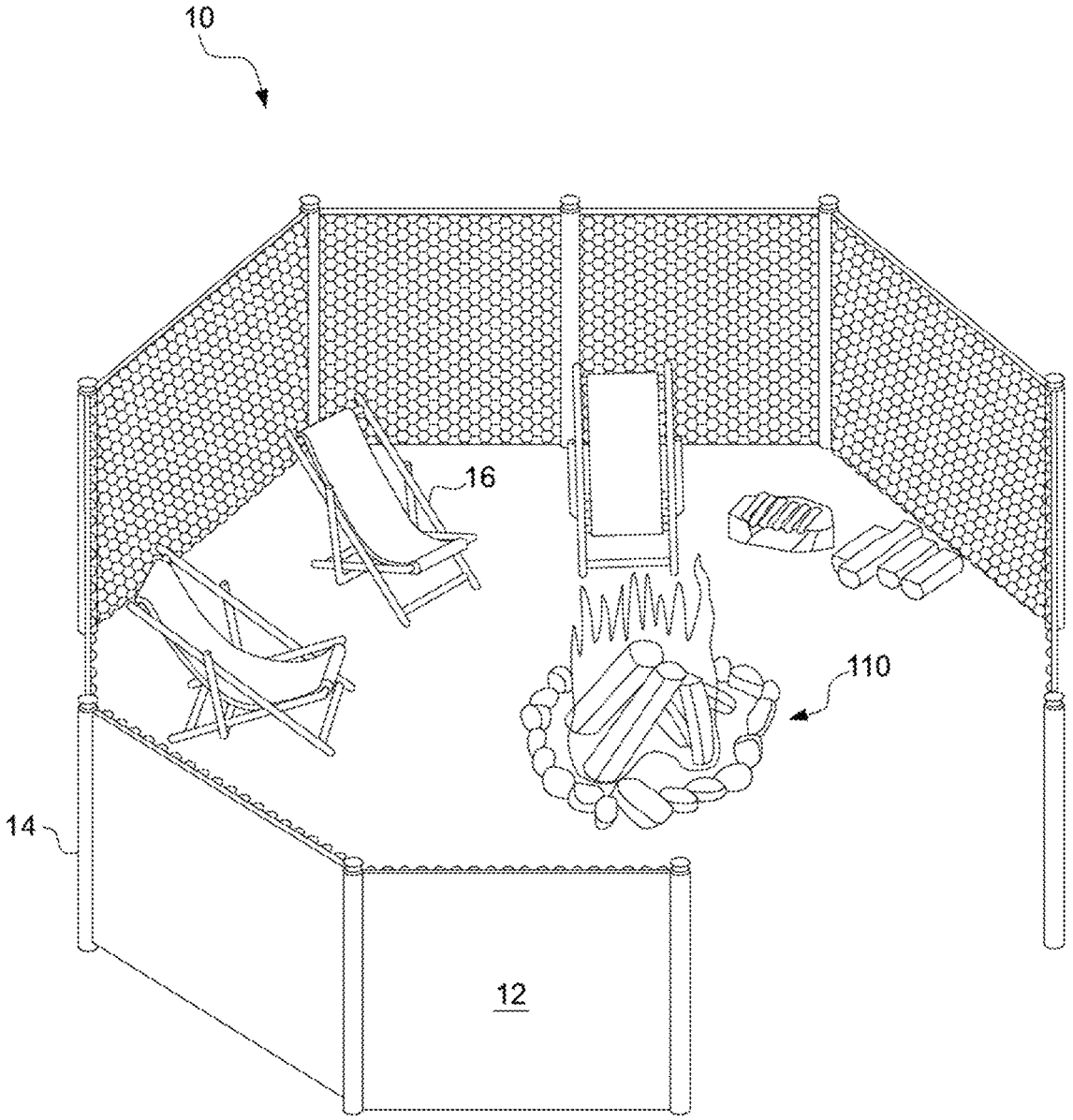
Fig. 1 PRIOR ART
FIGS. 1 and 2 illustrate prior art heat reflectors.

In the following description, the present invention is set forth in the context of various alternative embodiments and implementations of a light weight, portable, heat reflective shield. The heat reflective shield may be positioned adjacent a heat source so that heat from the heat source may be reflected thereto. For example, a hiker may position the heat reflective shield adjacent a heat source such as a campfire and position themselves between the campfire and the heat shield so that the heat from the campfire may be reflected from the heat shield back toward the hiker.

Definitions and Abbreviations

Various aspects of the devices and methods of use thereof disclosed herein may be illustrated by describing components that are coupled, attached, and/or joined together. As used herein, the terms "coupled," "attached," and/or "joined" are interchangeably used to indicate either a direct connection between two components or, where appropriate, an indirect connection to one another through intervening or intermediate components. In contrast, when a component is referred to as being "directly coupled", "directly attached," and/or "directly joined" to another component, there are no intervening elements shown in said examples.

Various aspects of the devices and methods of use thereof disclosed herein may be illustrated with reference to one or more exemplary implementations. As used herein, the term "exemplary" means "serving as an example, instance, or illustration," and should not necessarily be construed as preferred or advantageous over other variations of the systems, devices, and methods disclosed herein. "Optional" or "optionally" means that the subsequently described component, event, or circumstance may or may not be included or occur, and the description encompasses instances where the component or event is included and instances where it is not.

Furthermore, throughout the specification, reference to "one embodiment," "an embodiment," or "some embodiments" means that a particular described feature, structure, or characteristic is included in at least one embodiment. Thus, appearances of the phrases "in one embodiment," "in an embodiment," or "in some embodiments" in various places throughout this specification are not necessarily all referring to the same embodiment. Those skilled in the art will recognize that the various embodiments can be practiced without one or more of the specific details or with other methods, components, materials, etc. In other instances, well-known structures, materials, or operations are not shown or not described in detail to avoid obscuring aspects of the embodiments.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the various parts of the systems and devices disclosed herein may be used unless otherwise indicated.

It must also be noted that as used herein and in the appended claims, the singular forms "a," "an," and "the" include the plural reference unless the context clearly dictates otherwise. Unless defined otherwise, all technical and scientific terms used herein have the same meanings as commonly understood by one of ordinary skill in the art.

All numerical quantities stated herein are approximate, unless indicated otherwise, and are to be understood as being prefaced and modified in all instances by the term "about". The numerical quantities disclosed herein are to be understood as not being strictly limited to the exact numerical values recited. Instead, unless indicated otherwise, each numerical value included in this disclosure is intended to mean both the recited value and a functionally equivalent range surrounding that value.

All numerical ranges recited herein include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value equal to or less than 10.

As generally used herein, the terms "include," "includes," and "including" are meant to be non-limiting. As generally used herein, the terms "have," "has," and "having" are meant to be non-limiting.

Aspects and Embodiments of the Present Disclosure

The present disclosure provides a light weight, portable, heat reflective shield that is inflatable and thus does not require any poles or external support members to achieve and maintain a final shape. This provides a vast improvement over prior art heat shields 10 that generally included a plurality of structural support walls 12 held together by stakes 14, such as shown in FIG. 1. The user would position themselves, such as seated in a chair 16, between a heat source 110 and the heat shield 10. This arrangement is large, not foldable to a compact form, and thus not easily portable.

Figure 2:
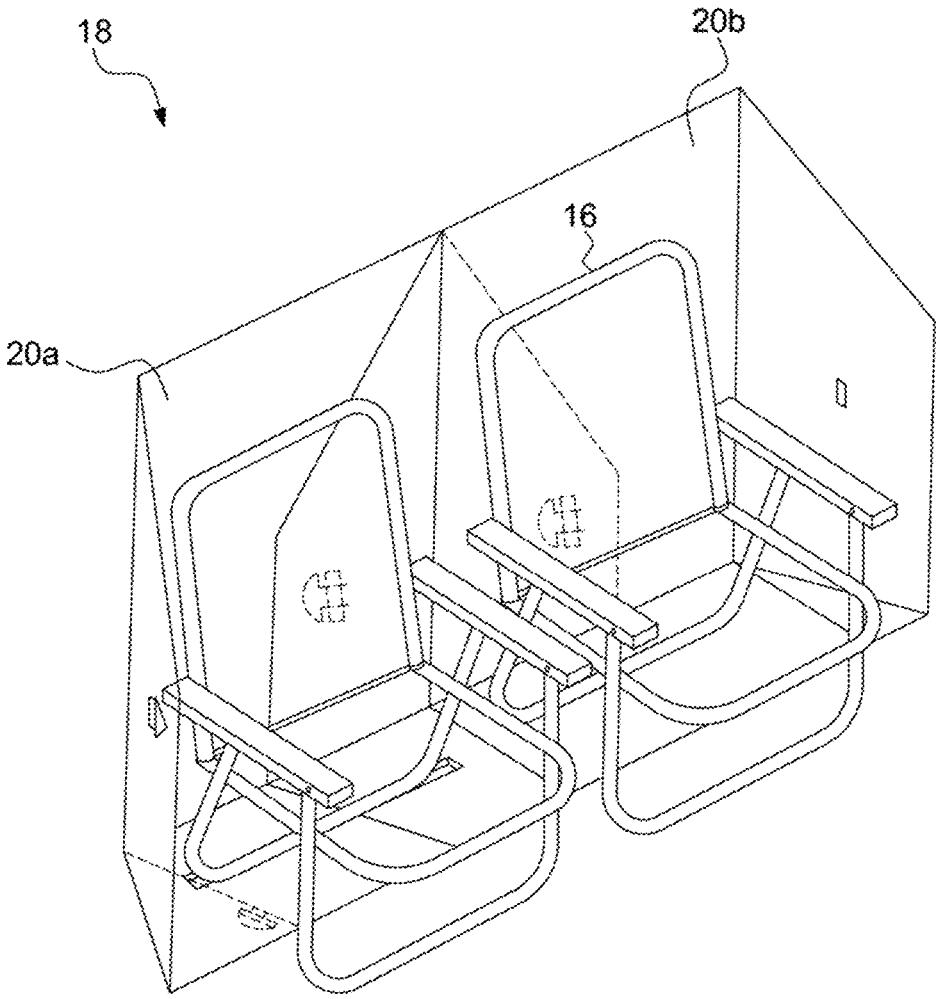
Fig. 2 PRIOR ART

A more portable prior art heat shield is shown in FIG. 2, wherein left 20*a* and right 20*b* panels of the shield are combined to form an enclosure 18 that is sized to accept one or more chairs 16. When positioned in front of a heat source, the radiant heat from the heat source would be reflected to the user's back. As with the prior art heat shield shown in FIG. 1, the components are bulky and, while more portable that other prior art heat reflective shield, not easily portable by a hiker such as in a backpack.

Figure 3:
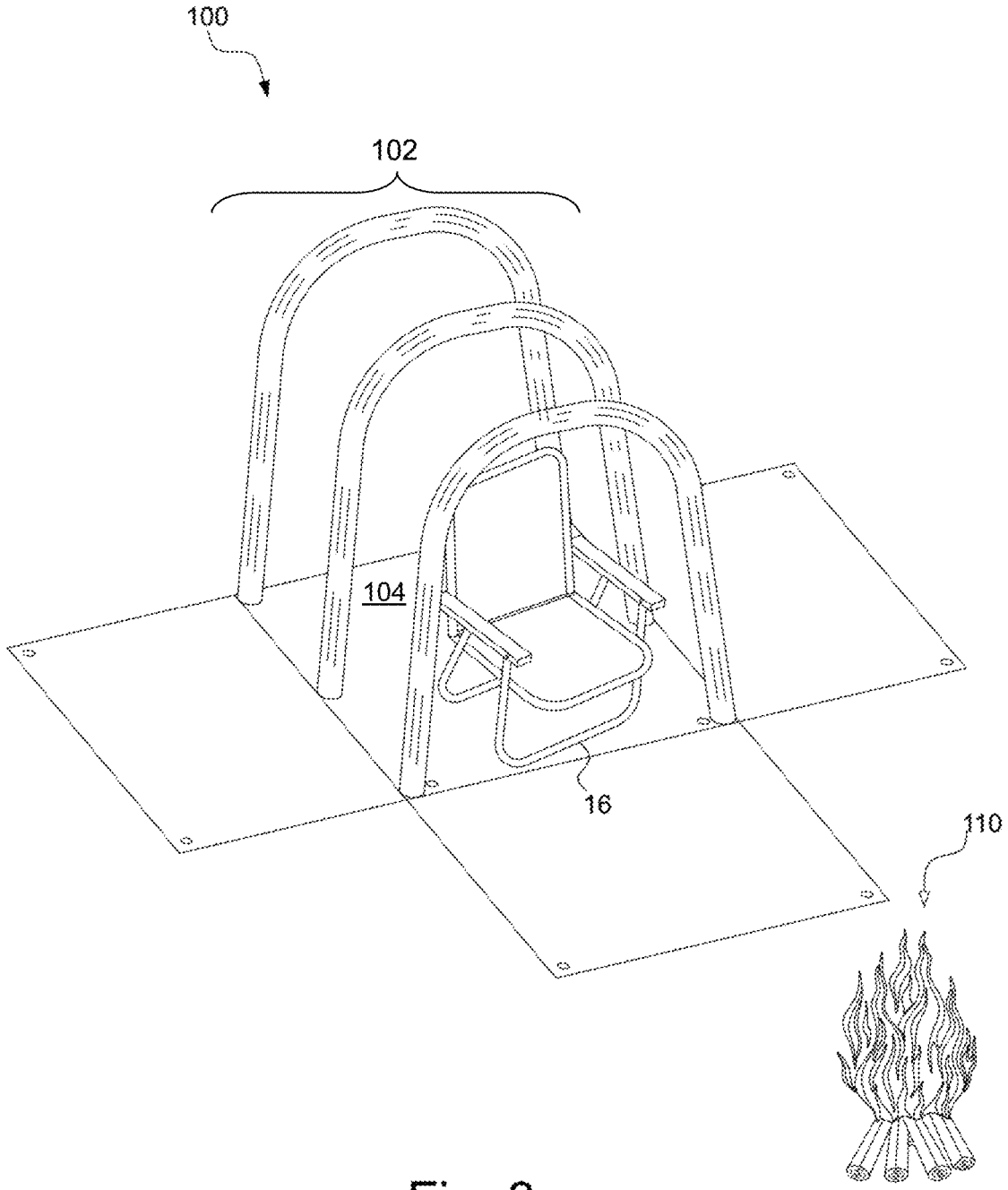
FIG. 3 illustrates a perspective front view of a light weight, heat reflective shield according to aspects of the present disclosure, wherein a position of a seat within the heat reflective shield is shown.

The inventive heat reflective shields provided in the present disclosure are light weight and easily transported. An exemplary heat reflective shield 100 is shown in FIG. 3. The shield includes a base panel 104 and a body portion 102 attached to and extending upward from the base panel. The body portion 102 is generally formed by a panel of thin, light weight material (not shown in FIG. 3 for clarity) that is supported by at least two inflatable ribs (three are shown in FIG. 3). When the inflatable ribs are filled with air, the shield 100 is generally configured to have an open front side and a concave body portion having an inner side and an outer side. The inner side of the body portion 102 is sized and configured to accommodate a standing or seated person, such as seated in a chair 16. When positioned adjacent a heat source, such as a campfire 110, the radiant heat from the heat source provides warmth to portions of the body that are oriented toward the heat source, e.g., a front side of the user, while the reflective heat from the heat source is available to areas that are oriented toward the heat reflective shield 100, e.g., the user's back.

Figure 4:
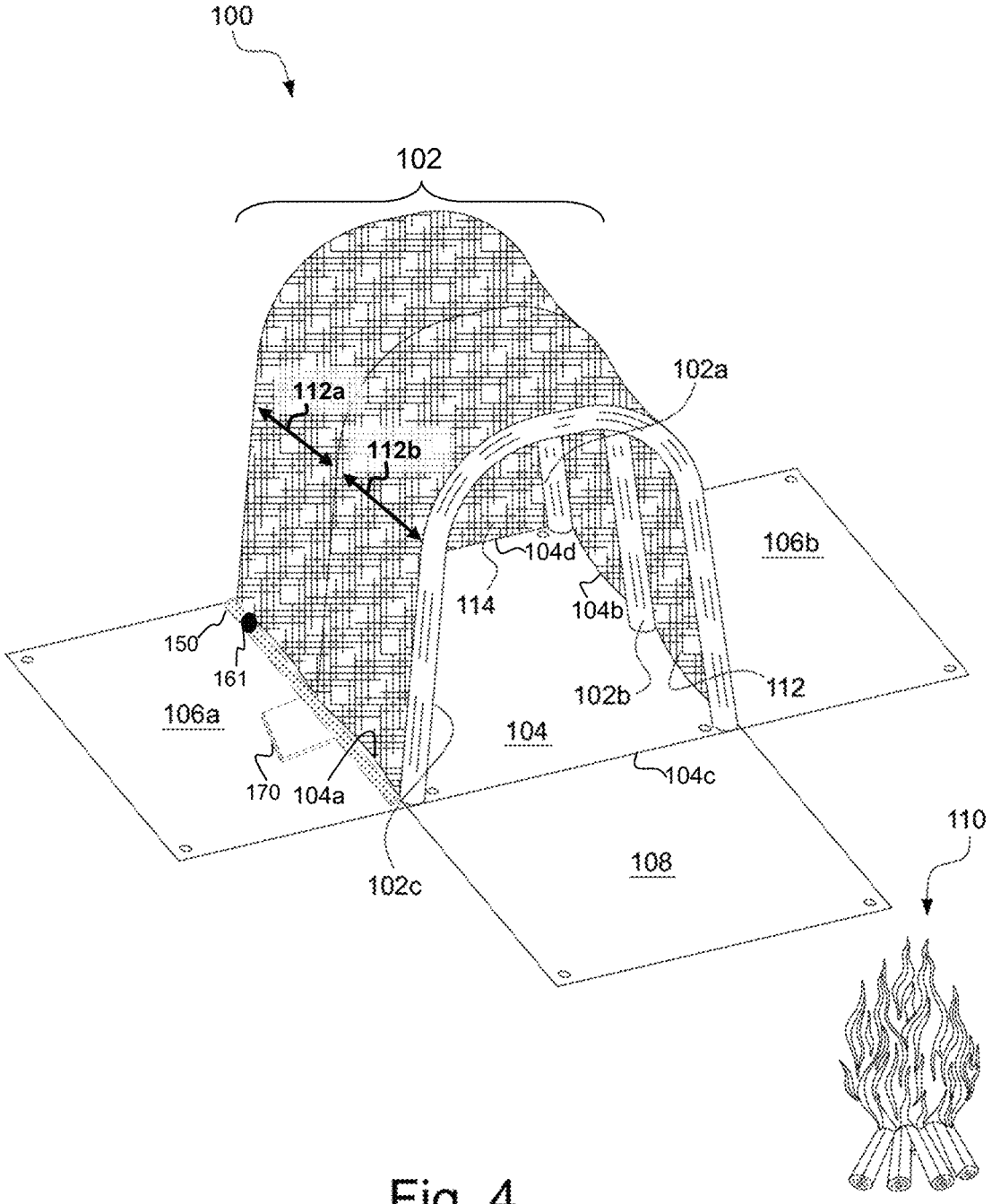
FIG. 4 illustrates a perspective front view of the heat reflective shield of FIG. 3.
Figure 5:
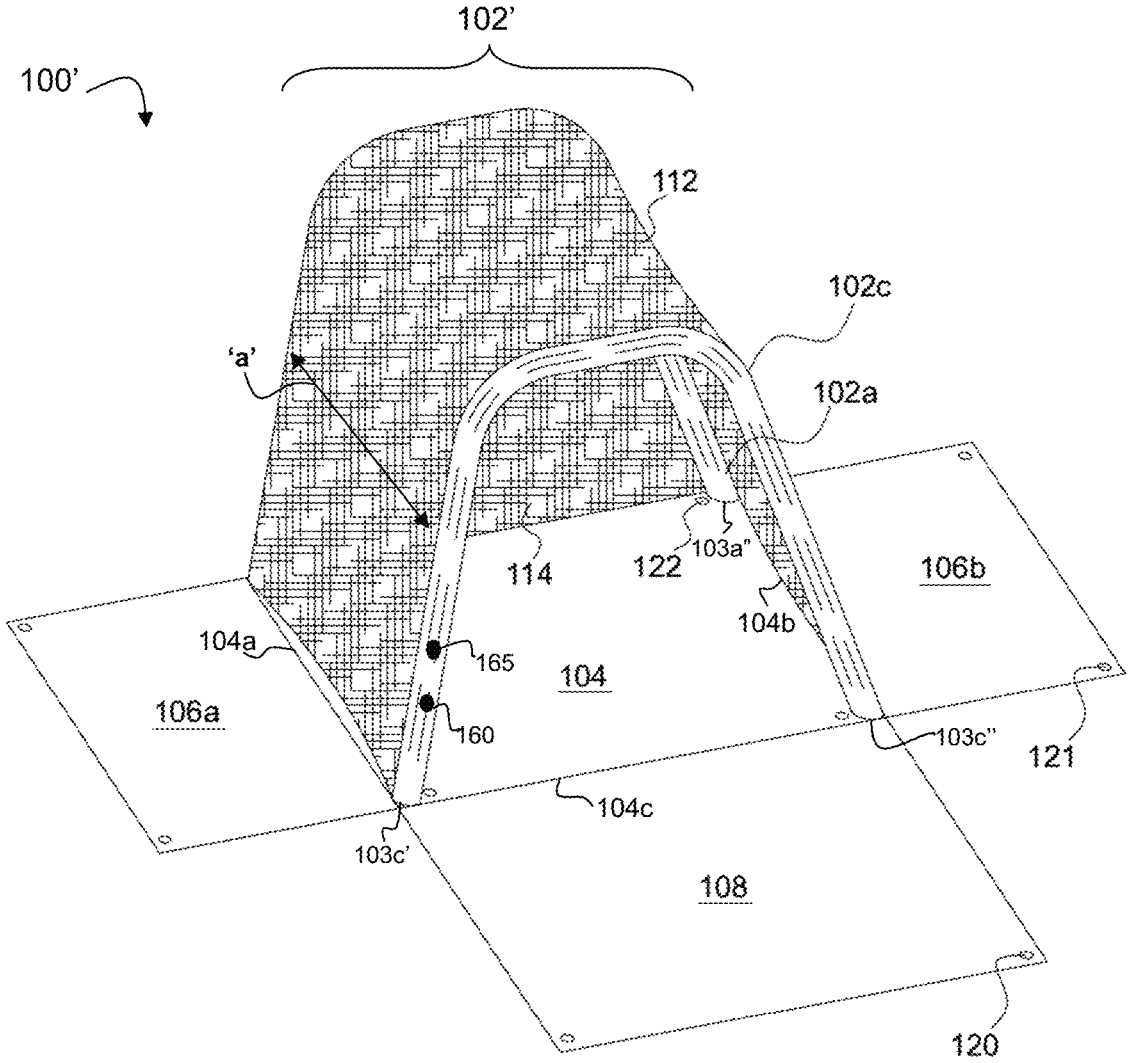
FIG. 5 illustrates a perspective front view of another light weight, heat reflective shield according to aspects of the present disclosure.

With reference to FIGS. 4 and 5, the heat reflective shield 100 comprises a base panel 104 having opposing first and second side edges (104*a*, 104*b*), and a front edge 104*c*. Extending upward from the base panel, and connected thereto, is a concave body portion 102. Both the base panel 104 and the concave body portion 102 are formed of a light weight, flexible, textile. Non-limiting examples of textiles useful in various embodiments of the present disclosure include at least nylon, rayon, polyester, polyimide, or blends thereof. The textile may be watertight and/or airtight, wherein watertight means that no moisture and in particular no rainwater or surface water can penetrate, and airtight means that no uncontrolled exchange of air can take place. Preferable textiles may include those capable of withstanding elevated temperatures, such as temperatures of at least 110° F., such as at least 120° F., or at least 130° F., or at least 140° F., or at least 160° F.

A portion of the inner side of the concave body portion may be reflective to radiant heat, i.e., heat reflective. That is, at least a portion of an inner surface on the inner side may be composed of a heat reflective textile or may include a heat reflective coating. As used herein, a heat reflective material is any material which has a low emissivity in the infrared portion of the electromagnetic spectrum. In other words, the material is a poor emitter, and a good reflector, of the radiant heat energy given off by a heat source such as a campfire. A common example of a radiant barrier material is a "space blanket" or "emergency blanket," which is typically made of a plastic sheet which has at least one very shiny silver side. Another radiant barrier material is a metallized, such as an aluminized or "silvered," light weight rip-stop nylon fabric. This material is particularly well-suited to the applications described herein.

When aluminized, an aluminized side of the material is generally silver in color, and very shiny. The material may be aluminized on one side only, in which case the other side is of a normal fabric color and finish, or it can be aluminized on both sides. The shiny, aluminized side is the low-emissivity, thermally reflective side of the material. Exemplary heat reflective textiles include at least RB Fabric™ and Temptrol® Metalized Cloth that include a layer of aluminum on one side.

According to certain aspects, the entire inner surface of the concave body portion may comprise a textile having a heat reflective surface or coating. When the heat reflective shield is positioned adjacent a heat source, the heat reflective material of the inner surface reflects heat from the heat source back toward the heat source, i.e., back toward a person positioned between the shield and the heat source.

The concave body portion 102 attached to and extending upward from the base panel 104 is supported by at least two inflatable ribs (102*a*, 102*c*) and includes an open front face along the front edge 104*c* of the base panel 104. With specific reference to FIG. 5, the concave body portion 102' may comprise only two inflatable ribs (102*a*, 102*c*). A first inflatable rib 102*a* includes a first end attached to the first side edge 104*a* of the base panel 104 and a second end 103*a*" attached to the second side edge 104*b* of the base panel. A second inflatable rib 102*c* includes a first end 103*c*' attached to the first side edge 104*a* of the base panel 104 and a second end 103*c*" attached to the second side edge 104*b* of the base panel. In general, the ends of the first inflatable rib 102*a* are positioned on the base panel 104 close to a back edge thereof, opposite the front edge 104*c*, and the ends (103*c*', 103*c*") of the second inflatable rib 102*c* are positioned on the base panel 104 close to a front edge 104*c* thereof. Accordingly, the first and second inflatable ribs (102*a*, 102*c*) are spaced apart on the base panel by a distance 'a'.

The concave body portion 102' further comprises a side panel 112 that spans the distance 'a' between the first and second inflatable ribs (102*a*, 102*c*) and is attached thereto. The side panel 112 is further attached to the base panel along a contour line on the first and second side edges of the base panel defined by attachment points of the first ends and second ends, respectively, of the first and second inflatable ribs to the base panel. As shown in FIG. 5, these contour lines are defined by the side edges (104*a*, 104*b*) of the base panel 104. Should the respective ends of the inflatable ribs be attached at a point inward from the side edges, the contour lines would be defined along a line positioned inward from the edge of the base panel.

With reference to FIG. 4, the concave body portion may include three inflatable ribs (102*a*, 102*b*, and 102*c*), wherein at least two of the inflatable ribs (102*a* and 102*c*) are as defined with respect to FIG. 5. When a third or additional inflatable rib 102*b* is included, it may be positioned between the first and second inflatable ribs, and attached to a position on the base panel along the contour line defined by attachment points for the ends of the first and second inflatable ribs (i.e., a straight line or a line that bows outward from the inner side of the concave body portion, such as when the first and second inflatable ribs are attached inward from the edges of the base panel).

When more than two inflatable ribs are included, such as shown in FIGS. 3 and 4, the side panel may be further attached to the additional inflatable rib (e.g., 102*b*) along a top or bottom thereof. For example, as shown in FIG. 4, the side panel 112 may be positioned above the additional inflatable rib 102*b*. According to certain aspects, the side panel may be formed of multiple panels, each panel spanning the distance between a respective set of inflatable ribs. For example, the side panel 112 may include a first panel portion 112*a* that spans the distance between, and is attached to, the first and third inflatable ribs (102*a* and 102*b*, respectively), and a second panel portion 112*b* that spans the distance between, and is attached to, the third and second inflatable ribs (102*b* and 102*c*, respectively).

While each of the inflatable ribs are shown in FIGS. 4 and 5 to be of similar dimensions, e.g., diameter and height, the inflatable ribs nearer to the back edge of the base panel could have a reduced height, so that a "roof" area of the concave body portion slopes inward and down toward a back side thereof. Moreover, the diameter of each inflatable rib could be larger near the attachment point with the base panel and smaller near an apex or mid-point of the inflatable rib, or the various inflatable ribs could have varied diameters according to specific design considerations.

As shown in each of FIGS. 4 and 5, the concave body portion 102 generally includes a back panel 114 that spans an area defined by, and connected to, a rear most of the at least two inflatable ribs 102*a* with respect to the front edge of the base panel. The back panel is further attached to the base panel 104 along a contour line on the base panel defined by attachment points of the first and second ends (first end is not visible in FIGS. 4 and 5, second end 103*a*" is shown in FIG. 5) of the rearmost of the at least two inflatable ribs.

With continued reference to FIGS. 4 and 5, the base panel may include perforations 122, such as grommet holes or eyelets, which may be used to position a stake to anchor the heat reflective shield to the ground. Exemplary stakes include lightweight plastic and metal stakes having a wider top portion that is restricted from passing through the perforation 122, or that include a hook at a top end, or any other anchoring means known in the art.

According to certain aspects, the heat reflective shield may include ground extensions, such as a first ground panel 108 attached to, and extendable away from, the front edge 104*c* of the base panel 104. The heat reflective shield may additionally or alternatively include second and third ground panels (106*a*, 106*b*) attached to, and extendable away from, the first and second side edges (104*a*, 104*b*, respectively) of the base panel 104. These ground panels may be used to anchor the heat reflective shield, such as by providing additional perforations (120, 121; e.g., grommet holes or eyelets) that may be useful for placement of one or more stakes. Alternatively, or additionally, the ground panels may be used to anchor the heat reflective shield by providing an area on which heavy objects can be placed, such as rocks, etc. In this way, should the user not have stakes, the ground panels not have perforations, or the ground on which the heat reflective shield is to be placed not be amenable to use of stakes, the user can still anchor the heat reflective shield.

Figure 6:
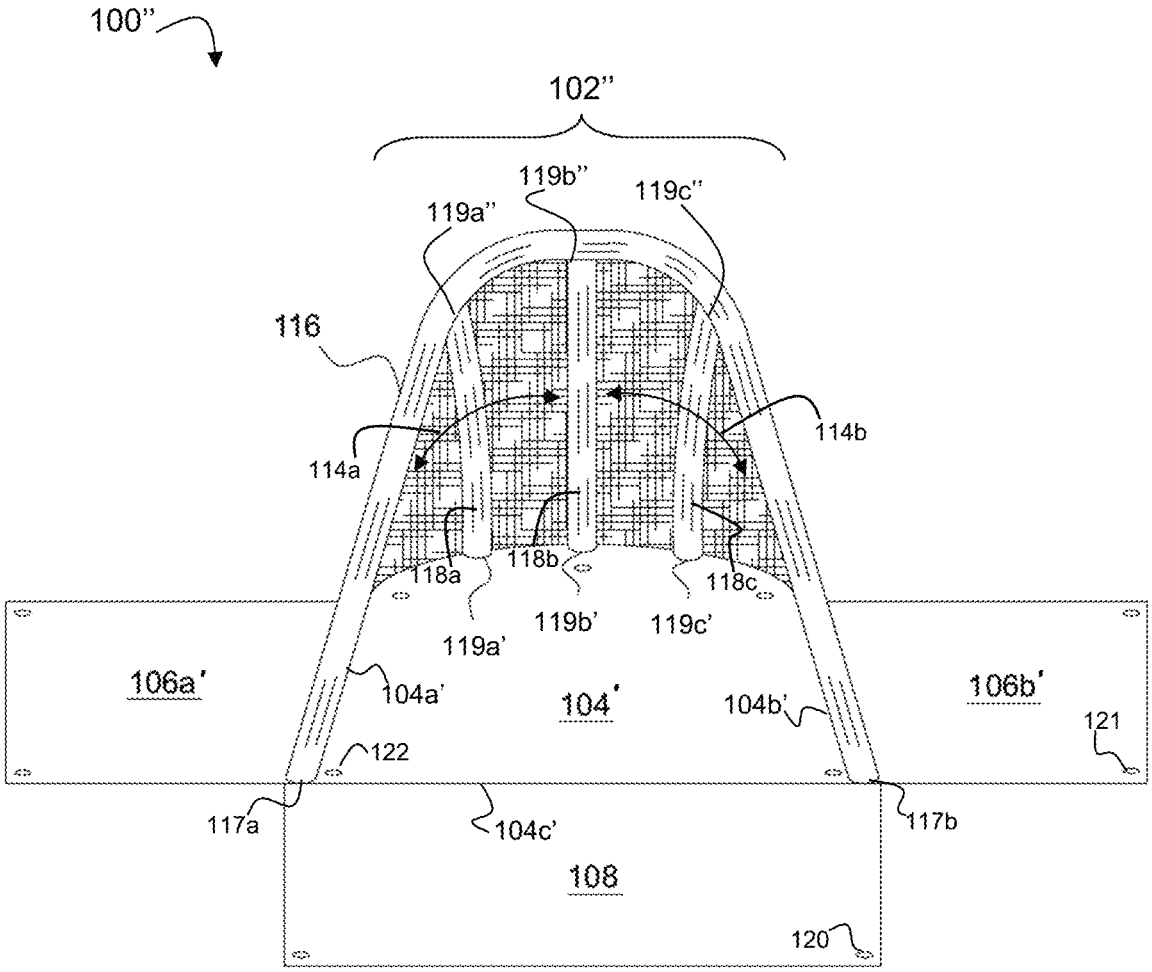
FIG. 6 illustrates a perspective front view of another light weight, heat reflective shield according to aspects of the present disclosure.

With reference to FIG. 6, another configuration of a heat reflective shield of the present disclosure is shown. The concave body portion 102" may comprise a first inflatable rib and at least one additional inflatable rib positioned perpendicular to the first inflatable rib. That is, the concave body portion 102" includes a first inflatable rib 116 having a first end 117*a* attached to the first side edge 104*a*' of the base panel 104' and a second end 117*b* attached to the second side edge 104*b*' of the base panel 104'. The concave body portion 102" further comprises a second inflatable rib 118*b* having a first end 119*b*' attached to a back edge of the base panel opposite the front edge 104*c*' and a second end 119*b*" attached to a midpoint of the first inflatable rib 116 between the first and second ends thereof (117*a*, 117*b*, respectively).

The concave body portion may include a single back panel that spans an area defined by, and is connected to, the first inflatable rib 116 and the base panel 104' along a contour line on the base panel defined by an attachment point of the first end 117*a* of the first inflatable rib 116, an attachment point of the first end 119*b*' of the second inflatable rib 118, and an attachment point of the second end 117*b* of the first inflatable rib 116.

The back panel may be further attached to the second inflatable rib 118*b* along a top or bottom of the second inflatable rib (i.e., the back panel is positioned above or below the second inflatable rib). According to certain aspects, the back panel may be formed of multiple panels, each panel spanning an area between a respective set of inflatable ribs. That is, the back panel may include a first back panel portion 114*a* that spans the area between, and is attached to, the left half of the first inflatable rib 116, the second inflatable rib 118*b*, and the base panel along a contour line on the base panel defined by the attachment point of the first end 117*a* of the first inflatable rib 116 and the attachment point of the first end 119*b*' of the second inflatable rib 118*b*. The back panel may include a second back panel portion 114*b* that spans the area between, and is attached to, the right half of the first inflatable rib 116, the second inflatable rib 118*b*, and the base panel along a contour line on the base panel 104" defined by the attachment point of the first end 119*b*' of the second inflatable rib 118*b* and the attachment point of the first end 117*a* of the first inflatable rib 116.

According to certain aspects, the heat reflective shield shown in FIG. 6 may include additional inflatable ribs. For example, a third and fourth inflatable rib (118*a*, 118*c*) each having a first end (e.g., 119*a*', 119*c*') attached to the back edge of the base panel and a second end (e.g., 119*a*', 119*c*') attached to the first inflatable rib, wherein the at least third and fourth inflatable ribs are positioned on opposite sides of the second inflatable rib and spaced apart therefrom. In this case, the back panel or panels may be attached to each additional inflatable rib (118*a*, 118*c*) along a top or bottom thereof (i.e., the back panel is positioned above or below the additional inflatable ribs). Alternatively, the back panel may be formed of multiple back panels, each spanning an area defined by the inflatable ribs as described hereinabove.

The heat reflective shield of FIG. 6 may also include ground panels. For example, ground panel 108 may be attached to, and extendable away from, the front edge 104*c*' of the base panel 104', and/or additional ground panels (106*a*', 106*b*') may be attached to, and extendable away from, the first and second side edges (104*a*', 104*b*', respectively) of the base panel 104'. As described hereinabove, these ground panels may be used to anchor the heat reflective shield, such as by providing perforations (e.g., 120, 121, 122) that may be useful for placement of one or more stakes. Alternatively, or additionally, the ground panels may be used to anchor the heat reflective shield by providing an area on which heavy objects can be placed, such as rocks, etc.

Figure 7:
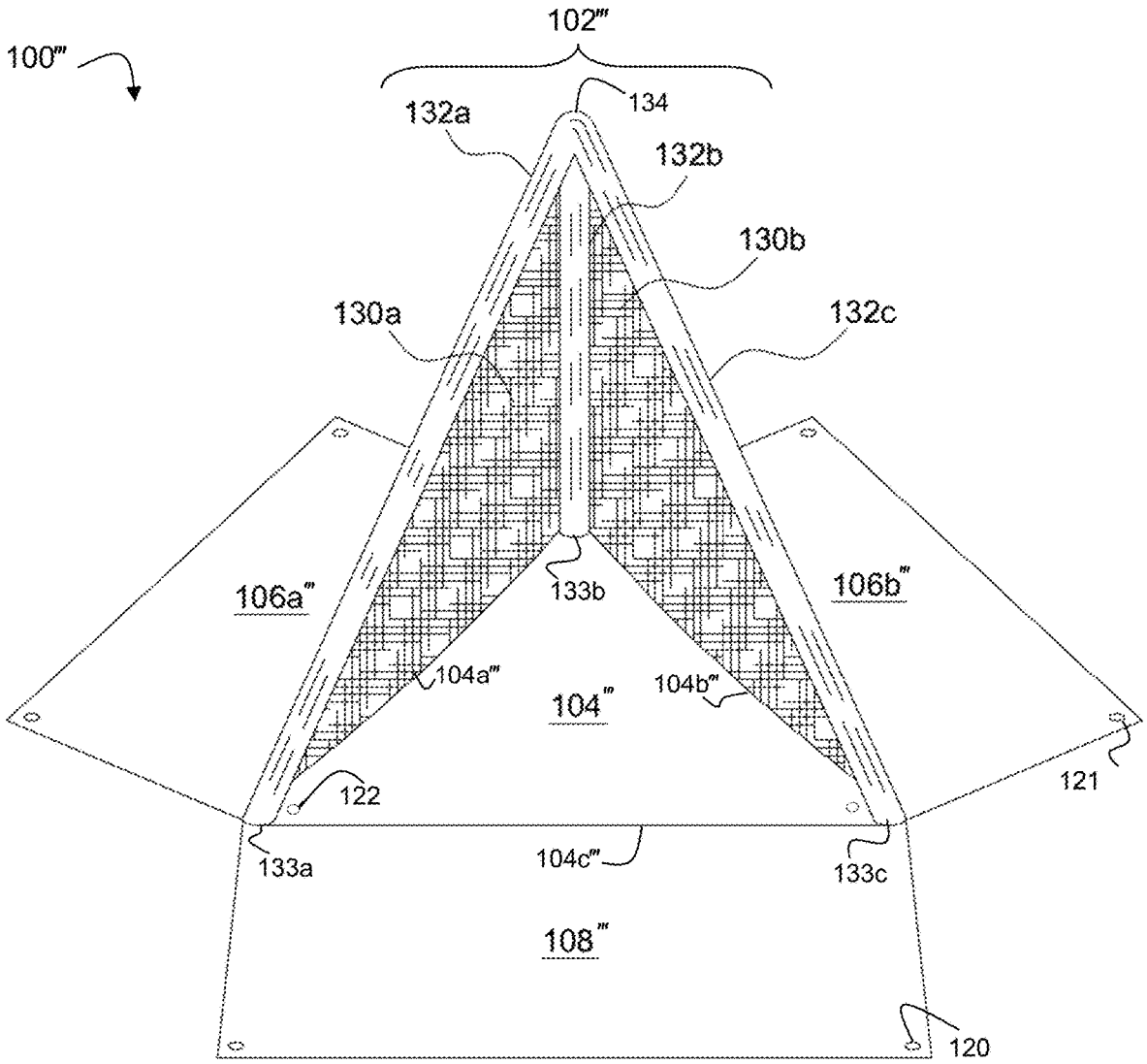
FIG. 7 illustrates a perspective front view of another light weight, heat reflective shield according to aspects of the present disclosure.

With reference to FIG. 7, another configuration of a heat reflective shield of the present disclosure is shown. The concave body portion 102" may comprise a base panel 104" that is shaped as a triangle, and the concave body portion may comprise three inflatable ribs that extend upward from the base panel to an apex, thus forming a triangular pyramid. That is, the concave body portion 102" may comprise a first, second, and third inflatable rib (132*a*, 132*b*, 132*c*) each having a first end attached to a first, second, and third vertex (133*a*, 133*b*, 133*c*, respectively), respectively, of the triangular base panel 104" and a second end attached at an apex 134 of the concave body portion.

The concave body portion 102", further comprises a first and second side panel (130*a*, 130*b*). The first side panel 130*a* spans an area between the first and second inflatable ribs and the base panel 104", along a first side edge 104*a*" thereof and is connected thereto, and the second side panel 130*b* spans an area between the second and third inflatable ribs and the base panel along a second side edge 104*b*", thereof and is connected thereto.

Moreover, as with the other embodiments disclosed herein, the heat reflective shield may further include ground panels. For example, ground panel 108" may be attached to, and extendable away from, the front edge 104*c*" of the base panel, and/or ground panels (106*a*", 106*b*") may be attached to, and extendable away from, the first and second side edges (104*a*", 104*b*", respectively) of the base panel 104". As described hereinabove, these ground panels may be used to anchor the heat reflective shield, such as by providing perforations (e.g., 120, 121, 122) that may be useful for placement of one or more stakes. Alternatively, or additionally, the ground panels may be used to anchor the heat reflective shield by providing an area on which heavy objects can be placed, such as rocks, etc.

Each of the inflatable ribs described herein may be filled with air, such as through a valve or closable port. For example, each inflatable rib may include a fill valve (e.g., 160 of FIG. 5) such as a port that is sealable with a cap. Air may be forced through the port and captured within the inflatable rib when the cap is secured thereon. The fill valve could also include a one-way valve that provides for air passage in one direction, i.e., inward to fill the inflatable rib. In this case, air may be released from the inflatable rib via a second openable port 165, or by manual compression of the one-way valve (e.g., squeezing the side of the one-way valve to force it open to both flow directions).

Alternatively, or additionally, a single fill valve 161 may be included that is in fluid communication with each of the inflatable ribs, such as via a common inflatable tube 150 (see FIG. 4). In this case, air that is forced through the single fill valve 161 may fill the common inflatable tube 150 and each of the inflatable ribs.

According to certain aspects, the heat reflective shield could be packaged with a pump, such as a foot operated accordion pump. Such a pump may be connectable with the air valves 160 or the single air valve 161 via a flexible air line or tubing, wherein the combination may be compact and easy to carry. Preferably, the air line would be permanently connected to the air pump and could be configured to manually plug into each air valve or a common air valve to inflate the inflatable rib. When inflation is complete, the air line may be removed and the valve closed in any well-known fashion, such as by insertion of a plug which is permanently attached to the valve by a short length of flexible plastic.

According to certain aspects, the pump may be incorporated within the structure of the heat reflective shield 100, such as shown in FIG. 4 wherein the pump 170 is positioned adjacent a fill tube 150 and connected or connectable to the fill valve 161. Exemplary pumps include a foot operated accordion or bellows pump.

The heat reflective shield may further include at least one pressure regulating valve that may be configured to relieve pressure at a preset high-pressure value. For example, should an overpressure condition occur during filling of the inflatable ribs, either individually or together via the fill tube 150 and associated fill valve 161, the pressure regulating valve would release some air to reduce the pressure and avoid possible rupture of the inflatable ribs. Moreover, the pressure regulating valve may also work to relieve an overpressure event caused by heating of the air in the inflatable ribs, such as when positioned near a heat source such as a campfire.

Figure 8:
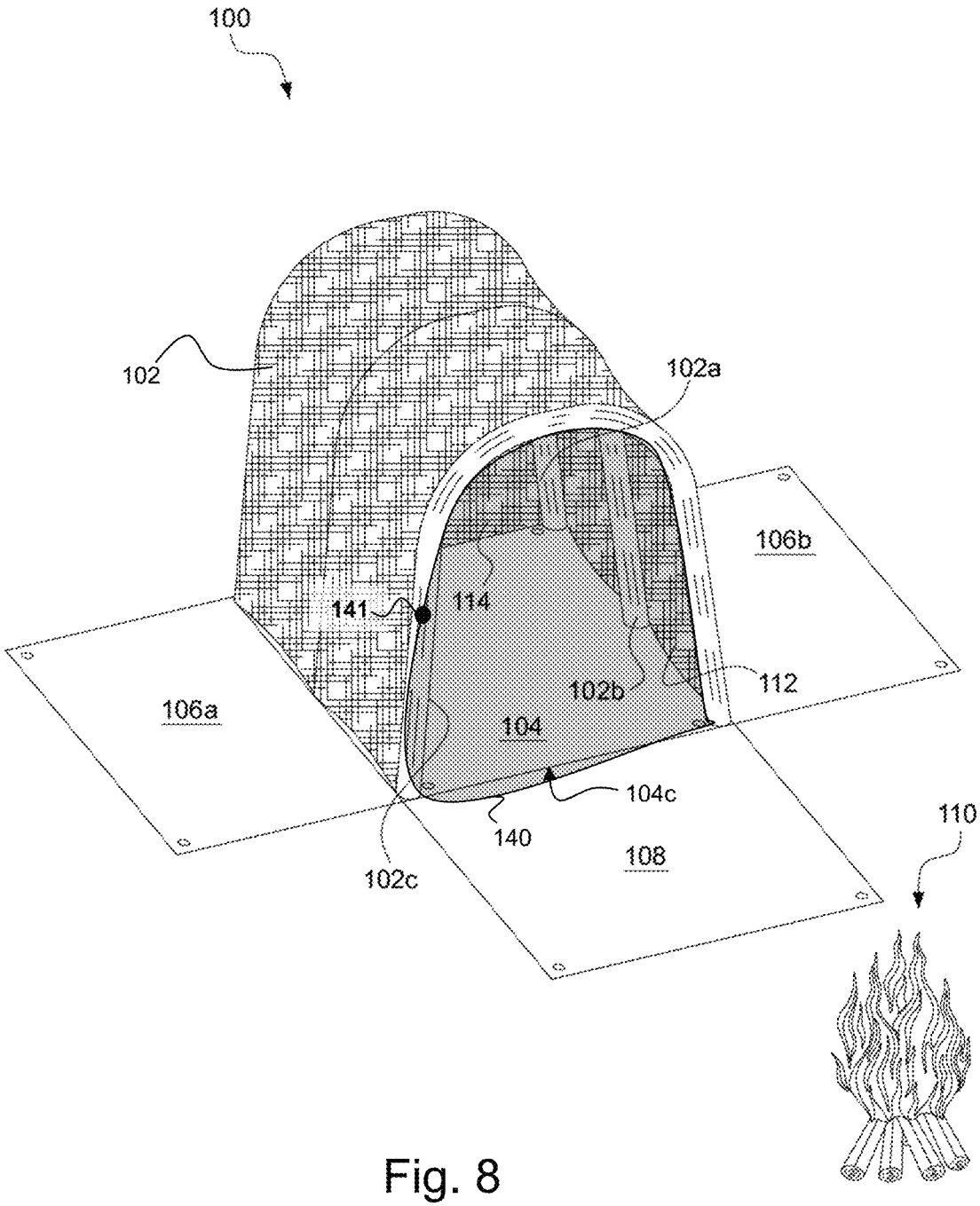
FIG. 8 illustrates a perspective front view of the heat reflective shield of FIG. 3; including a single flap covering a front opening.

The heat reflective shield may further include one or more flaps or a door that enclose the open front face. With reference to FIG. 8, the concave body portion 102 attached to and extending upward from the base panel 104 includes an open front face defined by the front edge 104*c* of the base panel 104 and the forward most inflatable rib 102*c*. A flap 140 may be included that is releasably or non-releasably attached along at least a portion of the forward most inflatable rib 102*c*, such as along a side as shown in FIG. 8, or along the top of the inflatable rib 102*c*, or a combination thereof. Releasable attachment (141) may be via Velcro™, hook and loop, snap, or button connections, a zipper, or other similar user releasable connections. Non-releasable connections may be via stitching or any other form of bonding, or the fabric of the body portion 102 may extend to form the flap 140.

Figure 9:
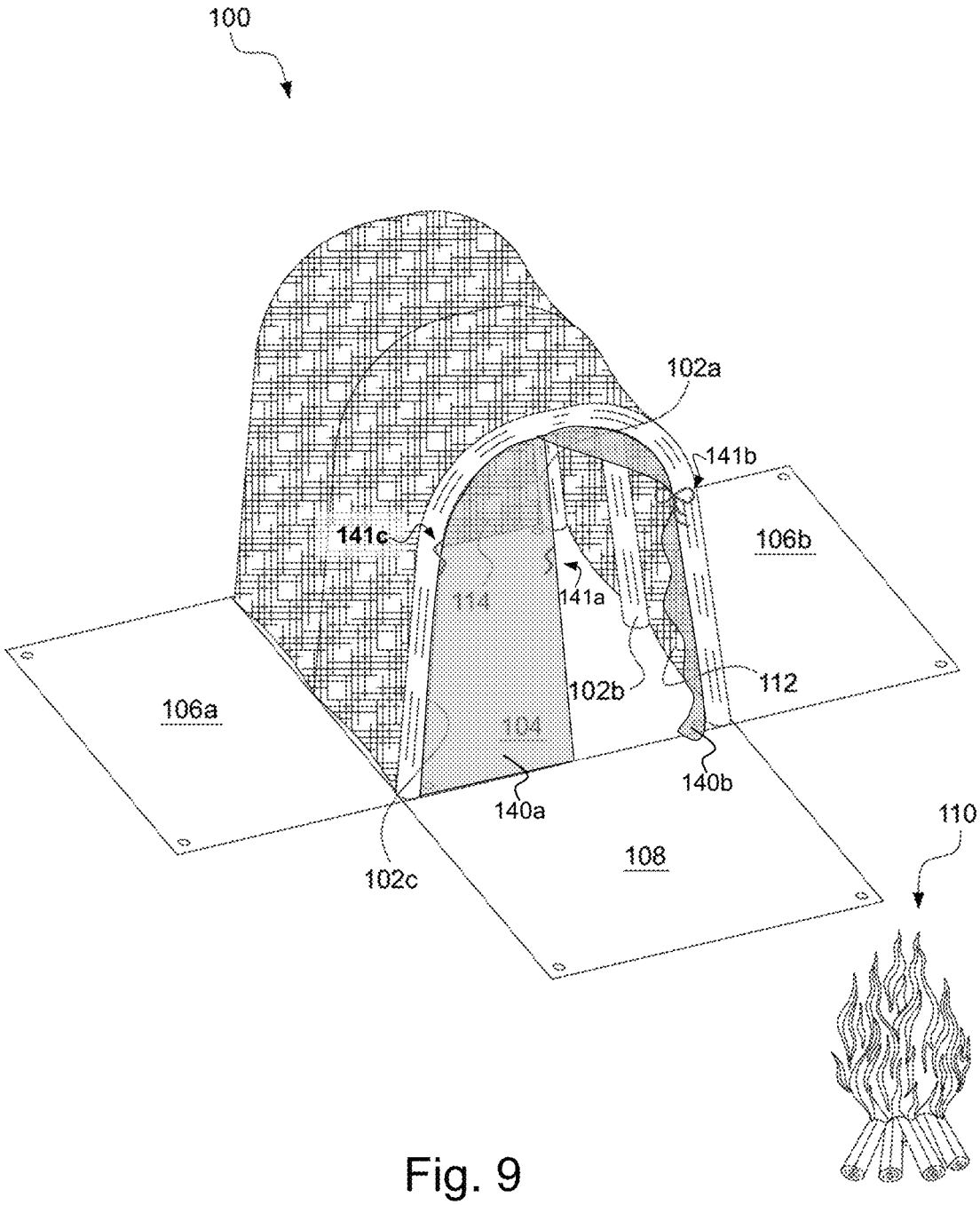
FIG. 9 illustrates a perspective front view of the heat reflective shield of FIG. 3; including two flaps covering a front opening.

According to certain aspects, the heat reflective shield may include two flaps that enclose the open front face. With reference to FIG. 9, each flap (140*a*, 140*b*) may be attached along opposing distal edges thereof to at least vertical sides of the forward most inflatable rib 102*c*, such as along one side and a top half of the forward most inflatable rib 102*c*. The flaps may not be attached along a bottom edge to the front edge 104*c* of the base panel 104. In this way, the two flaps may meet in the middle to form a slot or opening through which the user may pass to enter a region inside the heat reflective shield 100, i.e., inside the concave body portion. As shown in FIG. 9, one flap 140*a* is in a closed position and one flap 140*b* is held open by an attachment means 141*b*, shown as a tie-back.

Tie backs, hooks, grommets, Velcro™, or other attachment means known in the art may be included on the flap 140 (FIG. 8) or flaps (140*a*, 140*b*; FIG. 9) described hereinabove to secure them in an open position so that the open front face remains substantially unobstructed, or in a closed position. For example, in the open position, the flap or flaps may be rolled or folded up and secured with ties that connect to edges of the forward most inflatable rib 102*c* or to a region on the sides of the side panel 112. See for example the open flap 140*b* in FIG. 9 that is secured to a side of the forward most inflatable rib 102*c* by a tie 141*b*, wherein one tie may be on the flap and one tie may be on the inflatable rib (see 141*a* and 141*c*, respectively in FIG. 9), or two ties may be on the inflatable rib that may encircle the flap when tied together.

In the closed position, the flap 140 may be secured with a tie, button, hooks, grommets, Velcro™, etc. (141; FIG. 8) to an edge of the forward most inflatable rib 102*c* or to a region on the side of the side panel 112. Alternatively, when two flaps are included, they may be secured in a closed position by attaching open edges of the flaps (i.e., edges opposite from the connection with the forward most inflatable rib 102*c*) to each other via ties, buttons, Velcro™, hooks, zippers, and the like. For example, ties such as the tie 141*a* on the flap 140*a* shown in the closed position may be connected. Moreover, in either embodiment, i.e., as shown in FIG. 8 or 9, the bottom region of the flap(s) may be releasably attachable to the to the front edge 104*c* of the base panel 104 via any of ties, buttons, Velcro™, hooks, zippers, and the like.

When closed, the flaps may offer additional protection against the cold and/or weather, e.g., wind and rain, and/or insects while still allowing the concave inner surface of the body portion 102 to reflect heat from the campfire to warm the user. Moreover, in some embodiments, closing the flap 140 or flaps may retain heat within the inner region of the heat reflective shield offering greater warming.

Accordingly, the flap(s) may comprise a non-reflective material, such as a transparent or semi-transparent material, which may allow heat transmission from the campfire 110 to the inner region of the heat reflective shield 100. For example, the flap 140 may be formed of a thin heat resistant clear or transparent polymeric material such as polytetrafluoroethylene (PTFE), vinyl, polyvinyl chloride (PVC), silicone rubber sheeting, and the like.

The flap(s) may be formed of the same material as the body portion 102 of the heat reflective shield 100 absent any reflective coatings or reflective layers. That is, the flap may comprise a light weight, flexible, textile. Non-limiting examples of such textiles include at least nylon, rayon, polyester, polyimide, or blends thereof. The textile may be watertight and/or airtight, wherein watertight and/or airtight. Preferable textiles may include those capable of withstanding elevated temperatures, such as temperatures of at least 110° F., such as at least 120° F., or at least 130° F., or at least 140° F., or at least 160° F.

The flap(s) may be formed of a netting material, e.g., bug net. The flap(s) may be formed of a material or membrane that allows heat transmission in substantially one direction only. For example, the material may be opaque or non-transparent, and may include a reflective coating on the inside such that when the flap(s) is closed, the heat from the campfire may pass toward the inner concave region of the heat reflective shield and may become trapped or retained therein (e.g., like a one-way mirror).

The heat reflective shield may be configured to provide a user sufficient space for reclining or sleeping. While described and show thus far as providing the user with only enough space for standing or sitting in a chair, the heat reflective shield may include additional inflatable ribs, such as more than three, to extend a length and depth of the inner concave region. For example, and with specific reference to FIGS. 4, which shows three inflatable ribs (102*a-c*), one or more additional inflatable ribs may be included to support an additional length of the side panel 112 (e.g., the dimension spanning from the front 104*c* to the back 104*d* of the base panel 104). As such, the dimensions of the inner cavity, substantially defined by the dimensions of the base panel 104, would be sufficient to accommodate a sleeping person. For example, the heat reflective shield may be provided in a variety of dimensions to accommodate people of different heights. Some exemplary dimensions include at least five (5) feet long and at least two and a half (2.5) feet wide for younger or smaller users, or at least six and a half (6.5) feet long and three (3) feet wide for taller adults.

Other configurations, such as those shown in FIGS. 6 and 7, could also be extended to accommodate a sleeping person. For example, an additional rib may be included in front of the first inflatable rib 116, and spaced apart therefrom, wherein the front is defined by the front edge 104*c*' of the base panel 104'. With respect to the configuration shown in FIG. 7, one or more additional sets of first and third inflatable ribs (132*a* and 132*c*, respectively) may be included to extend a front region of the based panel, i.e., adjacent the front 104*c*" edge. In this latter case, the second inflatable rib 132*b* could be extended along a top region of the heat shield to provide support for the additional extra inflatable ribs. Moreover, the base panel 104" could be configured as a square with the triangular region shown extending from the back.

In yet other alternative arrangements, the flap(s) may be configured to be attachable along edges of the first ground panel (108, 108', 108") to extend a length of the inner cavity so that a person may have sufficient space to recline or sleep within the heat reflective shield.

Accordingly, while particular embodiments have been illustrated and described, it would be obvious to those skilled in the art that various other changes and modifications may be made without departing from the spirit and scope of the invention. Those skilled in the art will recognize or be able to ascertain using no more than routine experimentation, numerous equivalents to the specific apparatuses and methods described herein, including alternatives, variants, additions, deletions, modifications, and substitutions. This application including the appended claims is therefore intended to cover all such changes and modifications that are within the scope of this application.

What is claimed is:

1. A light weight, heat reflective shield comprising:

a base panel having opposing first and second side edges, and a front edge;

a first ground panel attached to and extendable away from the front edge of the base panel;

second and third ground panels attached to and extendable away from the first and second side edges, respectively, of the base panel; and a concave body portion attached to and extending upward from the base panel, the concave body portion comprising a top panel supported by a first inflatable rib having a first end attached to the first side edge of the base panel and a second end attached to the second side edge of the base panel, a second inflatable rib having a first end attached to a back edge of the base panel opposite the front edge and a second end attached to a midpoint of the first inflatable rib between the first and second ends thereof, and a third and fourth inflatable rib each having a first end attached to the back edge of the base panel and a second end attached to the first inflatable rib, wherein the at least third and fourth inflatable ribs are positioned on opposite sides of the second inflatable rib and spaced apart therefrom, wherein the top panel spans an area defined by and connected to: (i) the first inflatable rib, and (ii) the base panel along a contour line on the base panel defined by an attachment point of the first end of the first inflatable rib, an attachment point of the first end of the second inflatable rib, and an attachment point of the second end of the first inflatable rib, wherein the concave body portion includes an open front face along the front edge of the base panel, an inner side, and an outer side, wherein at least a portion of the inner side comprises a heat reflective material, wherein the heat reflective shield is constructed of a light weight flexible material, wherein, when the first, second, third, and fourth inflatable ribs are filled with air, the heat reflective shield is sized and configured to accommodate a standing or reclining person, and wherein, when the heat reflective shield is positioned adjacent a heat source, the heat reflective material of the inner side reflects heat from the heat source back toward the heat source.

2. The heat reflective shield of claim 1, wherein the reflective material is a reflective coating or a reflective textile.

3. The heat reflective shield of claim 1, comprising a fill valve in fluid communication with the first, second, third, and fourth inflatable ribs.

4. The heat reflective shield of claim 3, comprising a pressure regulating valve in at least one of the first, second, third, or fourth inflatable ribs, wherein the pressure regulating valve is configured to relieve a high-pressure condition therein.

5. The heat reflective shield of claim 1, wherein each of the first, second, third, and fourth inflatable ribs comprises a fill valve.

6. The heat reflective shield of claim 1, wherein the first, second, third, and fourth inflatable ribs comprise a pressure regulating valve configured to relieve a high-pressure condition of the first, second, third, and fourth inflatable ribs.

7. The heat reflective shield of claim 1, comprising:

an air delivery mechanism configured to provide air to fill the first, second, third, and fourth inflatable ribs with air.

8. The heat reflective shield of claim 7, wherein the air delivery mechanism comprises an integrated air pump configured to provide the air through at least one fill valve in fluid communication with the first, second, third, and fourth inflatable ribs.

9. The heat reflective shield of claim 1, wherein each of the first, second, and third ground panels include perforations configured to accept a fastening element therethrough.

10. The heat reflective shield of claim 1, wherein the base panel includes perforations configured to accept a fastening element therethrough.

11. The heat reflective shield of claim 1, further comprising:

at least one flap closeable over the open front face of the concave body portion, wherein the flap comprises a non-reflective material.

* * * * *